US010993590B2

(12) United States Patent
Marcus et al.

(10) Patent No.: US 10,993,590 B2
(45) Date of Patent: May 4, 2021

(54) APPARATUS AND METHOD FOR HOLDING AND DISPENSING A ROLL OF MATERIAL

(71) Applicants: Jason Marcus, South Amboy, NJ (US); Stephenie Marcus, South Amboy, NJ (US)

(72) Inventors: Jason Marcus, South Amboy, NJ (US); Stephenie Marcus, South Amboy, NJ (US)

( * ) Notice: Subject to any disclaimer, the term of this patent is extended or adjusted under 35 U.S.C. 154(b) by 0 days.

(21) Appl. No.: 16/701,322

(22) Filed: Dec. 3, 2019

(65) Prior Publication Data

US 2020/0163499 A1 May 28, 2020

(51) Int. Cl.
*A47K 10/40* (2006.01)
*A47K 10/32* (2006.01)

(52) U.S. Cl.
CPC ..... *A47K 10/40* (2013.01); *A47K 2010/3233* (2013.01); *A47K 2010/3246* (2013.01); *A47K 2010/3253* (2013.01)

(58) Field of Classification Search
CPC ..... A47K 10/40; A47K 2010/3233; A47K 2010/3246; A47K 2010/3253
See application file for complete search history.

(56) References Cited

U.S. PATENT DOCUMENTS 2,790,608 A * 4/1957 Sieven ..... A47K 10/32 242/596.3
3,061,218 A 10/1962 Moore
3,266,742 A 8/1966 Pena
3,297,265 A * 1/1967 Turro ..... A47K 10/40 242/598.1
3,830,198 A * 8/1974 Boone ..... A47K 10/32 118/506
3,837,595 A * 9/1974 Boone ..... A47K 10/32 242/594.5
5,490,625 A * 2/1996 Myatt ..... A47K 10/3827 225/47
5,638,966 A * 6/1997 Kuntz ..... A47K 10/40 211/153
5,765,717 A 6/1998 Gottselig
6,045,087 A * 4/2000 Vislocky ..... B65H 75/14 242/608.2
6,056,233 A 5/2000 Von Schenk
6,189,828 B1 2/2001 Reilly
6,378,800 B1 * 4/2002 Apichom ..... A47K 10/40 242/560

(Continued)

FOREIGN PATENT DOCUMENTS

DE 10291132 T5 1/2011

*Primary Examiner* — Michael E Gallion
(74) *Attorney, Agent, or Firm* — Lincoln Square Legal Services, Inc.

(57) ABSTRACT

The present technology relates to apparatuses, systems, and methods for holding and dispensing a roll of material. The apparatus can comprise a supporting structure which can include an engaging member connected to a supporting member. The supporting member can comprise a connecting element. The engaging member can be configured to engage a household fixture. The connecting element can be configured to connect to a second connecting element of a second supporting structure such that the supporting members of the first and second supporting structure support a roll of material.

9 Claims, 2 Drawing Sheets

(56) References Cited

U.S. PATENT DOCUMENTS

| | | | | |
|---|---|---|---|---|
| 6,460,799 | B1 * | 10/2002 | Ryan | A47K 10/38 242/560.2 |
| 6,508,432 | B2 | 1/2003 | Krivulin | |
| D482,916 | S * | 12/2003 | Smurlick | D6/518 |
| 6,945,493 | B1 * | 9/2005 | Gottesman | A47K 10/38 242/560.2 |
| 7,278,604 | B1 | 10/2007 | Constantino | |
| 9,456,718 | B1 * | 10/2016 | Myatt | A47K 10/3827 |
| 10,682,024 | B1 * | 6/2020 | Dorn | A47K 10/40 |
| 2004/0075015 | A1 * | 4/2004 | Cain | A47K 10/38 242/595 |
| 2014/0061351 | A1 * | 3/2014 | Maruyama | B41J 15/02 242/160.3 |
| 2018/0229962 | A1 * | 8/2018 | Fahid | A47K 10/40 |

* cited by examiner

APPARATUS AND METHOD FOR HOLDING AND DISPENSING A ROLL OF MATERIAL

BACKGROUND

The present technology relates to apparatuses and methods for holding and dispensing a roll of material that are useful for a variety of applications, including, for example, holding and dispensing a second roll of toilet paper in a household bathroom.

Rolls of material can quickly run out. This can cause anxiety-filled situations in a household, commercial, or institutional context if the material runs out at an inopportune time. Currently marketed products generally include material dispensers that accommodate multiple rolls of material; however, these have disadvantages. For example, some require complicated installation and cannot be easily installed in a house or apartment. Others provide access to only one roll of material at a time. Others are unwieldy and do not allow the user to easily replace the rolls of material.

Therefore, a need exists for rolled material dispensers that are easy to use and that readily adapt to household, institutional, or commercial fixtures.

SUMMARY OF THE DISCLOSED TECHNOLOGY

In certain embodiments, the present technology is directed to an apparatus configured to dispense a roll of material, the apparatus comprising: an engaging member configured to engage a household fixture; and a supporting member connected to the engaging member, the supporting member comprising a connecting element, wherein the supporting member is configured to hold the roll of material.

In certain embodiments, the present technology is directed to a system configured to engage a household fixture and to dispense a roll of material, the system comprising: a first supporting structure comprising a first engaging member connected to a first supporting member, the first supporting member comprising a first connecting element; and a second supporting structure comprising a second engaging member connected to a second supporting member, the second supporting member comprising a second connecting element, wherein the first connecting element is configured to releasably engage with the second connecting element such that the first supporting member and the second supporting member together support a roll of material.

In certain embodiments, the present technology is directed to a method for dispensing a roll of material comprising a hollow inner tube, the method comprising: engaging a first engaging member of a first supporting structure with a household fixture; engaging a second engaging member of a second supporting structure with the household fixture; and positioning the roll of material between a first supporting member of the first supporting structure and a second supporting member of the second supporting structure such that a first connecting element of the first supporting structure and a second connecting element of the second supporting structure engage within the hollow inner tube.

DETAILED DESCRIPTION

As used herein, "roll of material" means any material wrapped around a tube that can be rotated about an axis to dispense a desired material. For example, a roll of material can comprise a roll of paper, such as toilet paper or paper towel, or dry or wet wipes, plastic wrap, aluminum foil, thread, ribbon, or any other material that for convenience or ease of use, a user may desire to dispense in such a manner.

As used herein, "household fixture" means any structure suitable for engaging with an apparatus discussed herein. As used herein, "household fixture" is not limited to structures found within a household and may be understood to also include suitable structures found in, or as part of, public spaces, institutions, and commercial settings, including public restrooms, places of business, office buildings, theaters, stadiums, schools, hospitals, and the like. For example, in certain embodiments a "household fixture" can comprise the horizontal cylindrical portion of an ordinary bathroom toilet paper holder. Alternatively, a "household fixture" can comprise the cylindrical portion of an ordinary towel rack or the horizontal or vertical edge of a door or cabinet, or even any portion or the entirety of, a toilet paper holder, a towel rack, a wall, a table, a counter, a desk, a household appliance, a shelf, or a cabinet.

As used herein, "standard toilet paper holder" means any structure available to the general American consumer that supports and allows a user to dispense a roll of toilet paper. In certain embodiments, "standard toilet paper holder" means an apparatus approximately 4-6 inches long by 3-6 inches wide by 4-6 inches high. Alternatively, "standard toilet paper holder" can mean a commercial toilet paper holder such as those found in schools, hospitals, and businesses with dimensions greater than 4-6 inches long by 3-6 inches wide by 4-6 inches high.

Figure 1A:
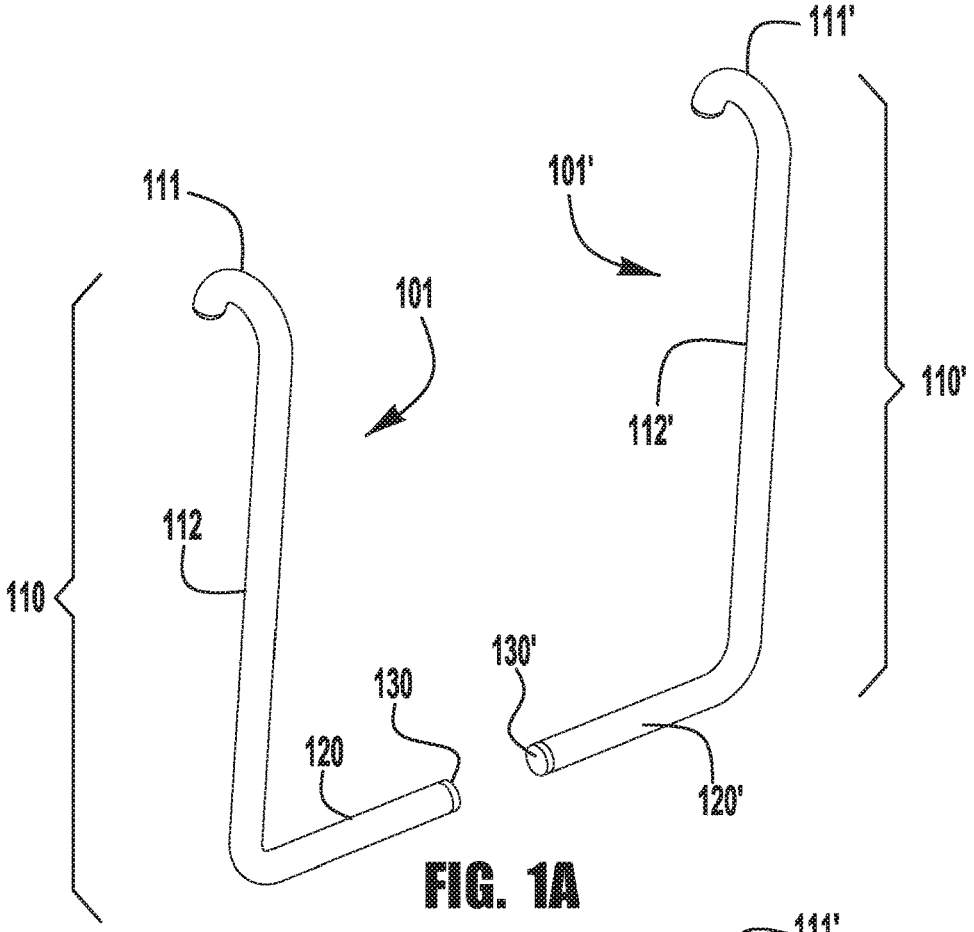
FIG. 1A shows a certain embodiment of the apparatus in which the connecting elements are not touching.

FIG. 1A depicts an embodiment of an exemplary apparatus in which the connecting elements are not touching. The embodiment shown in FIG. 1A can comprise two supporting structures 101, 101'. In certain embodiments, supporting structure 101 comprises engaging member 110 connected to supporting member 120. In various embodiments, engaging member 110 and supporting member 120 can be connected permanently, connected releasably (that is, they can be separated by pulling apart), or they can be regions of a unitary, single structure that is made of one continuous piece of material. In embodiments such as those depicted in FIG. 1A, engaging member 110 is configured to releasably engage a household fixture such that a user may easily engage and disengage the engaging member with the household fixture, but in certain embodiments, the engaging member will not disengage from the household fixture without user interaction. In certain embodiments, the household fixture is a standard toilet paper holder. In one embodiment, engaging member 110 is shaped in part or in whole as a hook 111 and can hook onto the household fixture, for example, engaging or releasing a bar, rod, hook, screw, adhesive, snap, groove, shelf, or the like. The body of engaging member 112 can vary in length in order to adapt the supporting structure to a height desired by the user.

In certain embodiments, supporting member 120 is configured to support a roll of material. For example, supporting member 120 can be a horizontal cylindrical rod. In certain embodiments, the rod can be substantially horizontal—that is, it need not be perfectly 0° from horizontal, but can be close enough to horizontal so as to support the roll of material sufficiently for use. In various embodiments, the rod can be configured diagonally or even vertically.

Figure 1B:
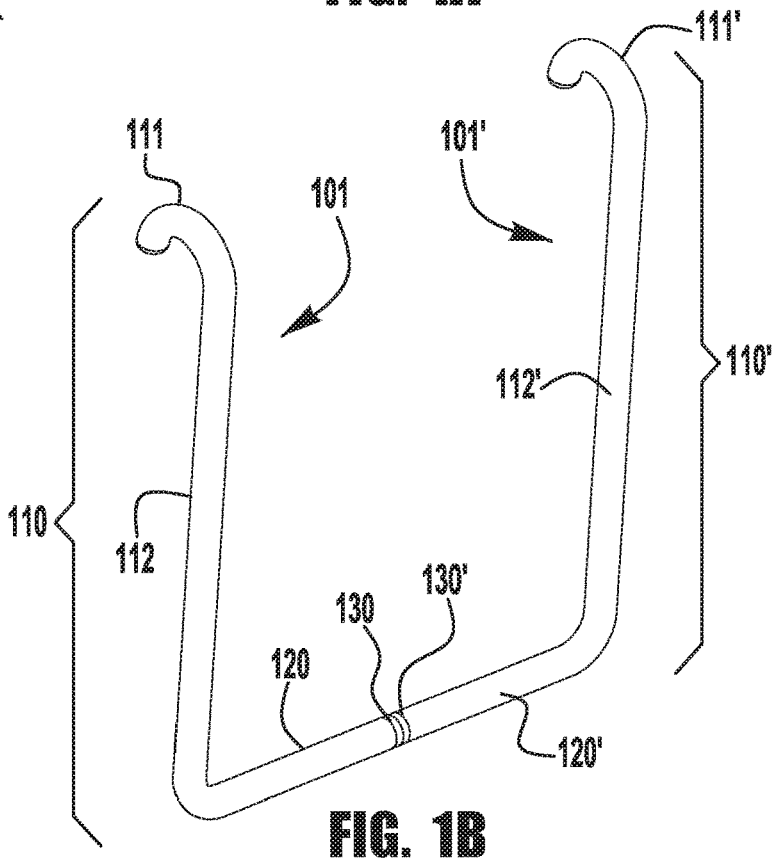
FIG. 1B shows a certain embodiment of the apparatus in which the connecting elements are touching.

The length of supporting member 120 can be varied to adapt to different lengths of rolls of material. In certain embodiments, supporting member 120 comprises a connecting element 130. In various embodiments, one or both of connecting elements 130, 130' can comprise a magnet, an interlocking mechanism, a snap, a hook, a hook and loop fastener, an adhesive, or other component to engage the connecting elements. As shown in FIG. 1B, in certain embodiments, connecting element 130 is configured to releasably engage with connecting element 130' of another supporting structure 101' such that supporting members 120, 120' of the two supporting structures 101, 101' together or individually, can support a roll of material. In certain embodiments, connecting elements 130, 130' engage by touching. In other embodiments, connecting elements 130', 130 engage without physically touching each other. In certain embodiments, the roll of material is a roll of toilet paper.

In one embodiment, the engaging member comprises a hook, the supporting member comprises a horizontal rod arranged substantially perpendicularly to the engaging member at a junction, and the connecting element comprises a magnet arranged at an end of the supporting member opposite of the junction.

In certain embodiments, a first supporting structure comprises a first engaging member, and the first engaging member comprises a first connecting element. In certain embodiments, a second supporting structure comprises a second engaging member connected to a supporting member. The supporting member comprises a second connecting element, and the first connecting element of the first engaging member is configured to releasably engage with the second connecting element of the supporting member.

In certain embodiments, one or both of the engaging member or supporting member can comprise a cylindrical rod or a substantially cylindrical rod. As used herein, "substantially cylindrical" means any three dimensional object with a length greater than its width that can be inserted into or engage with a tube as described herein and allows the tube to rotate. In other embodiments, one or both of the engaging member or supporting member can comprise a bar in the shape of any three-dimensional prism that can support a tube, for example, a rectangular prism.

In various embodiments, the engaging member can have a length of 1 to 12 inches, 3 to 9 inches, 6 to 8 inches, 1 to 4 inches, or 9 to 12 inches. In various embodiments, the supporting member can have a length of 1 to 12 inches, 3 to 9 inches, 6 to 8 inches, 1 to 4 inches, or 9 to 12 inches. The lengths of the engaging member and the supporting member can vary depending on the size of the roll of material and the desired distance of the supporting member from the household fixture.

In various embodiments, one or both of the engaging member or the supporting member comprise plastic, wood, metal, ceramic, paper, or a combination thereof. The apparatus can comprise any material suitable for supporting and dispensing a roll of material.

Figure 2:
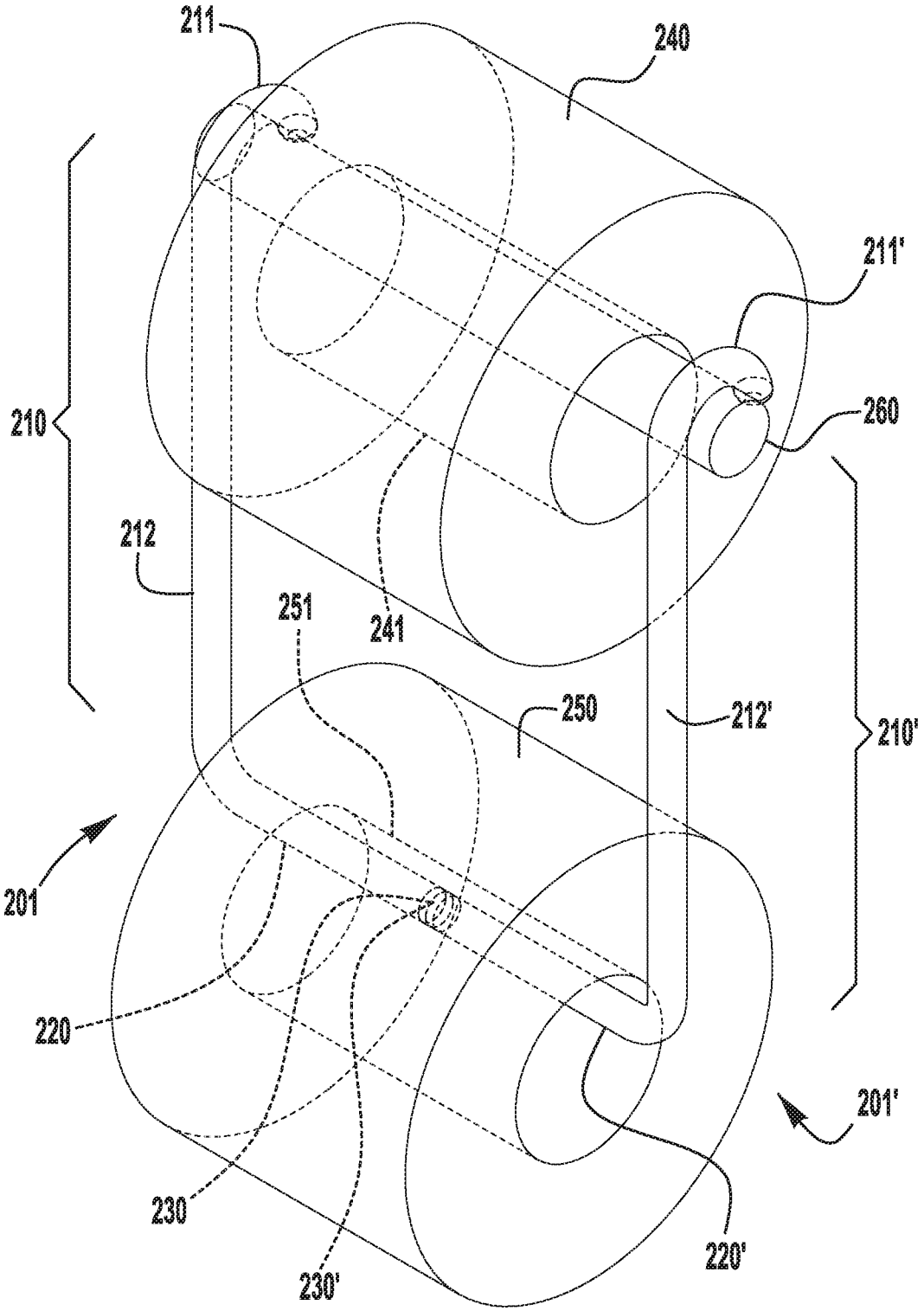
FIG. 2 shows an embodiment of the present technology in which the disclosed apparatus engages with a household fixture and supports a second roll of material.

FIG. 2 depicts an embodiment of a system for holding and dispensing a roll of material comprising two of the supporting structures 201, 201' described above. In this embodiment, engaging members 210, 210' are configured to engage a household fixture 260. In certain embodiments, engaging members 210, 210' include hooks 211, 211'. In certain embodiments, the household fixture 260 is a standard toilet paper holder. The household fixture comprises a first substantially cylindrical horizontal rod that supports a first roll of material 240. Connecting elements 230, 230' are configured to engage within hollow inner tube 251 of a second roll of material 250, such that supporting members 220, 220' form a second substantially horizontal rod that supports second roll of material 250 beneath first roll of material 240. In certain embodiments, one or both of connecting elements 230, 230' is a magnet. In certain embodiments, the second roll of material 250 is a roll of toilet paper. In one embodiment, supporting members 220, 220' form a rod that is substantially parallel to household fixture 260. In certain embodiments, connecting elements 230, 230' engage by touching. In other embodiments, connecting elements 230, 230' engage without physically touching each other. The user of this system can dispense material from either or both first roll of material 240 or second roll of material 250.

In various embodiments, one or both of the engaging member or the supporting member comprise plastic, wood, metal, ceramic, paper, or a combination thereof. The apparatus can comprise any material suitable for supporting and dispensing a roll of material.

In certain embodiments, a first engaging member comprises a hook, a first supporting member comprises a horizontal rod arranged substantially perpendicularly to the first engaging member at a first junction, and a first connecting element comprises a magnet arranged at an end of the first supporting member opposite of the first junction. In certain embodiments, a second engaging member comprises a hook, a second supporting member comprises a horizontal rod arranged substantially perpendicularly to the second engaging member at a second junction, and a second connecting element comprises a magnet arranged at an end of the second supporting member opposite of the second junction, wherein the first connecting element is configured to releasably connect to the second connecting element within a hollow inner tube of the roll of material such that the first supporting member and the second supporting member together support the roll of material.

While FIG. 2 depicts a system in which two supporting structures are configured to support a second roll of material, the system can, in certain embodiments, also be configured to support multiple rolls of material. In certain embodiments, engaging members of one set of supporting structures can engage the supporting members of another set of supporting structures such that the system is capable of holding multiple rolls of material simultaneously in a substantially vertical configuration relative to each other.

In certain embodiments, the system of FIG. 2 can be configured such that a user can load, dispense, and reload a roll of material. In one embodiment of this method, the user first inserts the supporting members through an inner tube of a roll of material such that the connecting elements engage each other within the hollow inner tube of the roll of material. The user can then engage the engaging members with a household fixture. The user can finally dispense material from the roll of material. In certain embodiments, material can be dispensed by rolling the material over the roll of material, under the roll of material, or any other direction that allows the material to be dispensed. When the roll of material is depleted, the user can disengage the engaging members from the household fixture and repeat the process described above with another roll of material. Alternatively, when the roll of material is depleted, the user can disengage the connecting elements and replace the roll of material while the engaging members are still engaged with the household fixture. In certain embodiments, the household fixture is a standard toilet paper holder. In certain embodiments, the roll of material is a roll of toilet paper.

In one embodiment, the step of engaging the first engaging member with the household fixture comprises hooking the first engaging member onto a spindle of a standard toilet paper holder; the step of engaging the second engaging member with the household fixture comprises hooking the second engaging member onto the spindle of the standard toilet paper holder; and the step of positioning the roll of material between the first supporting member and the second supporting member further comprises magnetically engaging the first connecting element and the second connecting element within a hollow inner tube of a roll of toilet paper.

Although the present technology has been described in relation to particular embodiments thereof, these embodiments and examples are merely exemplary and not intended to be limiting. Many other variations and modifications and other uses will become apparent to those skilled in the art. The present technology should, therefore, not be limited by the specific disclosure herein, and can be embodied in other forms not explicitly described here, without departing from the spirit thereof.

We claim:

1. An apparatus configured to dispense a roll of material, the apparatus comprising:

a. an engaging member configured to engage a household fixture; and b. a supporting member connected to the engaging member, the supporting member comprising a connecting element, wherein the supporting member is configured to hold the roll of material;

wherein the engaging member comprises a hook, the supporting member comprises a horizontal rod arranged substantially perpendicularly to the engaging member at a junction, and the connecting element comprises a magnet arranged at an end of the supporting member opposite of the junction; wherein the connecting element is configured to releasably engage with a second connecting element of a second supporting member such that the supporting member and the second supporting member together support the roll of material.

2. The apparatus of claim 1 wherein one or both of the engaging member and the supporting member comprise plastic, metal, or wood.

3. The apparatus of claim 1 wherein the roll of material is a roll of toilet paper.

4. The apparatus of claim 1 wherein the household fixture is a standard toilet paper holder.

5. A system configured to engage a household fixture and to dispense a roll of material, the system comprising:

a. a first supporting structure comprising a first engaging member connected to a first supporting member, the first supporting member comprising a first connecting element; and b. a second supporting structure comprising a second engaging member connected to a second supporting member, the second supporting member comprising a second connecting element;

wherein the first engaging member comprises a hook, the first supporting member comprises a horizontal rod arranged substantially perpendicularly to the first engaging member at a first junction, and the first connecting element comprises a magnet arranged at an end of the first supporting member opposite of the first junction; and wherein the second engaging member comprises a hook, the second supporting member comprises a horizontal rod arranged substantially perpendicularly to the second engaging member at a second junction, and the second connecting element comprises a magnet arranged at an end of the second supporting member opposite of the second junction;

wherein the first connecting element is configured to releasably engage with the second connecting element such that the first supporting member and the second supporting member together support a roll of material.

6. The system of claim 5 wherein some or all of the first engaging member, the second engaging member, the first supporting member, and the second supporting member comprise plastic, metal, or wood.

7. The system of claim 5 wherein the roll of material is a roll of toilet paper.

8. The system of claim 5 wherein the household fixture is a standard toilet paper holder.

9. A method for dispensing a roll of material comprising a hollow inner tube, the method comprising:

a. engaging a first engaging member of a first supporting structure with a household fixture, by hooking the first engaging member onto a spindle of a standard toilet paper holder;

b. engaging a second engaging member of a second supporting structure with the household fixture, by hooking the second engaging member onto the spindle of the standard toilet paper holder; and c. positioning the roll of material between a first supporting member of the first supporting structure and a second supporting member of the second supporting structure such that a first connecting element of the first supporting structure and a second connecting element of the second supporting structure magnetically engage within the hollow inner tube of a roll of toilet paper.

* * * * *